US006695098B1

(12) United States Patent
Henley et al.

(10) Patent No.: US 6,695,098 B1
(45) Date of Patent: Feb. 24, 2004

(54) SELF-LOCKING WRAP TERMINATION FOR TENSION MEMBER

(75) Inventors: Randy G. Henley, Danbury, CT (US); Mark F. Orelup, Torrington, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/489,289

(22) Filed: Jan. 21, 2000

(51) Int. Cl.[7] ..... B66B 7/08
(52) U.S. Cl. ..... 187/411
(58) Field of Search ..... 187/411; 24/127

(56) References Cited

U.S. PATENT DOCUMENTS 1,436,566 A * 11/1922 Beaumont ..... 294/68.1
3,004,644 A * 10/1961 Hull ..... 24/127 X
3,352,273 A * 11/1967 Herreshoff et al. ..... 24/127 X
4,205,871 A * 6/1980 Manabe et al. ..... 24/127 X
4,458,388 A * 7/1984 Farago et al. ..... 24/115 R
5,855,254 A 1/1999 Blochle ..... 187/411

FOREIGN PATENT DOCUMENTS

DE 36 23 407 A1 1/1988
GB 2287447 * 9/1995

* cited by examiner

*Primary Examiner*—Steven A. Bratlie

(57) ABSTRACT

A termination for an elevator tension member is provided that terminates a load with frictional forces created by wrapping the tension member about a body and with compressional forces generated by the weight of the load compressing the tension member upon itself.

10 Claims, 4 Drawing Sheets

FIG.8
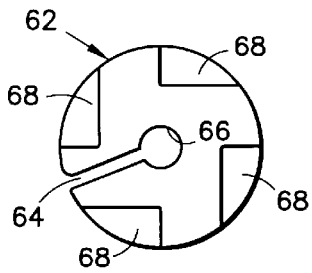
FIG.9
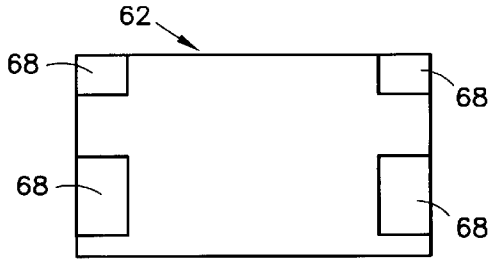
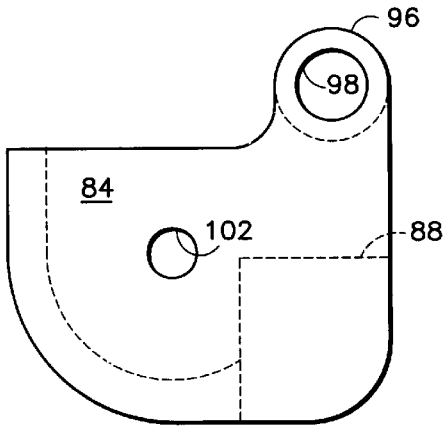
FIG.10
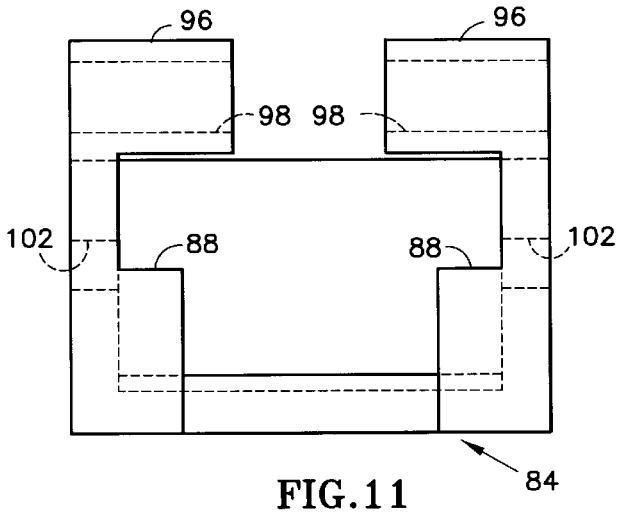
FIG.11
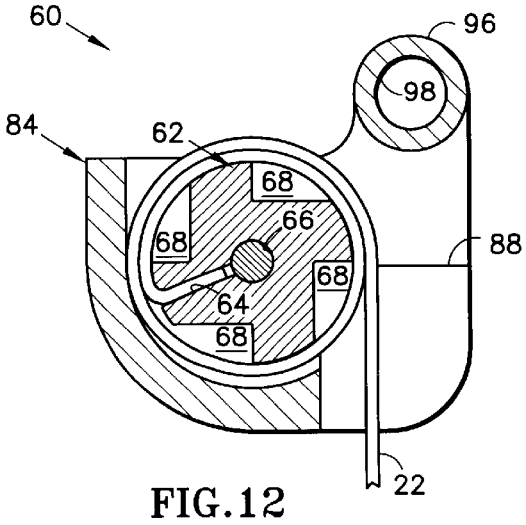
FIG.12
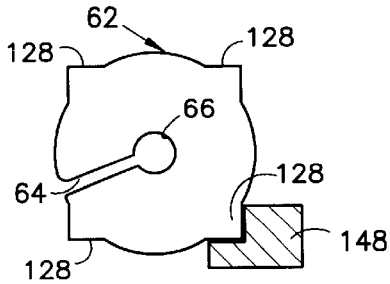
FIG.13

SELF-LOCKING WRAP TERMINATION FOR TENSION MEMBER

BACKGROUND OF THE INVENTION

The present invention relates to elevator systems. More particularly, the invention relates to various embodiments for terminating a tension member.

A conventional traction elevator system includes a car, a counterweight, two or more tension members interconnecting the car and counterweights, terminations for each end of the tension members at the connection points with the car and counterweights, a traction sheave to move the tension members, and a machine to rotate the traction sheave. Alternatively, 2 to 1 roping configurations are also common and typically include a car, a counterweight, two or more tension members interconnecting the car and counterweights, terminations for each end of the tension members at structural support points, a traction sheave to move the tension members, idler sheaves to interconnect the counterweight, the car and the traction sheave, and a machine to rotate the traction sheave.

The tension members have traditionally been formed of laid or twisted steel wire. Termination of such tension members at the car and counterweight in a traction elevator system, or, alternatively, at the structural support points for a 2 to 1 roping configuration elevator system, is conventionally effectuated by means such as compression terminations and wedge terminations.

Compression terminations of the prior art, which have been employed for ropes with an aspect ratio of one (round) and ropes with an aspect ratio of greater than one (flat) provide a reasonably broad range of pressures. However, even a simple compression termination requires multiple components, thereby making such a termination device relatively expensive to manufacture and time consuming to install. Wedge-type termination devices have also been employed for both round and flexible flat tension members and are effective, yet remain relatively expensive to manufacture.

Furthermore, with conventional termination devices, the pressure or holding force is exerted upon a portion of the tension member or rope equivalent in length to the holding surface of the device. Thus, for effective holding force, the length of the holding surface must be great enough to maintain the load.

Thus, the art is still in need of a reliable termination device that reaches an advantageous price point, is easy and timely to assemble, is easy and timely to disassemble and decreases clearance requirements.

SUMMARY OF THE INVENTION

The termination device of the present invention is a body having a particular configuration which facilitates a tension member being wrapped therearound for termination. In one embodiment, one end of the tension member is inserted in an aperture upon the body. The insertion does not intentionally hold any of the load force of the tension member (from a car or counterweight hanging thereon) but merely retains the tension member in position while the member is being wrapped around the termination device. The tension member is terminated (i.e., maintained in position during its working life) by friction of the tension member against the termination device (in the first wrap) and by a clamping force on the tension member provided by the member itself as it overlaps the first turn in the second partial wrap of the tension member through the clamping force and the frictional forces produced, all of the load force is reacted out of the system before reaching the end of the termination member inserted in the aperture.

In a preferred embodiment of the present invention, the body has a cylindrical surface.

The device of the present invention reliably terminates a tension member while using less material and requiring less clearance.

BRIEF DESCRIPTION OF THE DRAWINGS

Referring now to the drawings wherein like elements are numbered alike in the several FIGURES:

FIG. 8 is a side elevation view of a body of FIG. 7;

FIG. 9 is a front elevation view of a body shown in FIGS. 7 and 8;

FIG. 10 is a side elevation view of a support of the termination shown in FIG. 6;

FIG. 11 is a front elevation view of the support of FIG. 10;

FIG. 12 is a side cross-sectional view of the termination of FIG. 6; and FIG. 13 is a side cross-sectional view of another embodiment of the present invention.

DETAILED DESCRIPTION OF THE INVENTION

Figure 1:
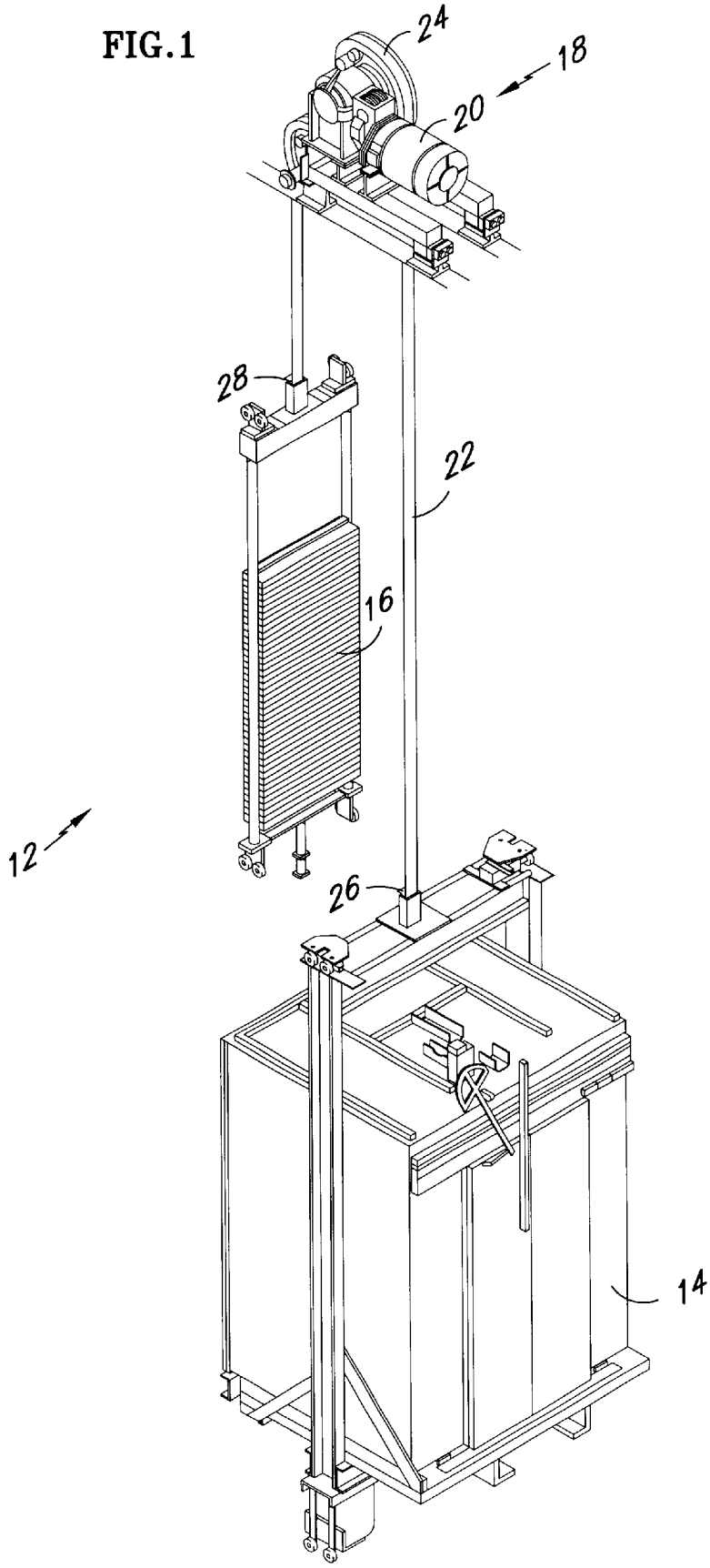
FIG. 1 is a perspective view of an elevator system.

Referring to FIG. 1, the relative location of the tension member termination device of the invention can be ascertained. For clarity, an elevator system 12 is illustrated having a car 14, a counterweight 16, a traction drive 18 and a machine 20. The traction drive 18 includes a tension member 22 interconnecting car 14 and counterweight 16 which member is driven by a sheave 24. Both ends of tension member 22, i.e., a car end 26 and a counterweight end 28 must be terminated. It is either of these termination points for a tension member with which the present invention is concerned. An exemplary tension member of the type contemplated in this application is discussed in further detail in U.S. Ser. No. 09/031,108 filed Feb. 26, 1998 entitled Tension Member For An Elevator and U.S. Ser. No. 09/218,990 also entitled Tension Member For An Elevator and filed Dec. 22, 1998, both of which are entirely incorporated herein by reference. Further, laid or twisted steel wire and conventional rope tension members may be accommodated with the termination system of the present invention. The elevator system depicted is provided solely for exemplary purposes to illustrate the location of the termination of the invention. Other elevator arrangements, such as a 2 to 1 roping configuration, may readily employ the termination detailed herein at the stationary support structures without departing from the invention. Therefore, when reference is made to a car end 26 and counterweight end 28, corresponding stationary support ends may be substituted thereby adapting the present description with a 2 to 1 roping configuration elevator system, as the location of the termination is irrelevant to the invention detailed herein.

Figure 2:
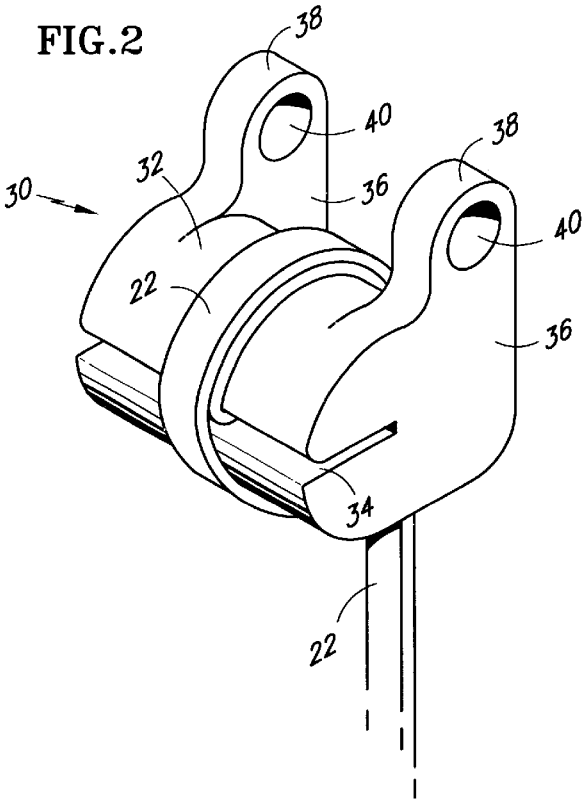
FIG. 2 is a perspective view of a termination assembly of the present invention.
Figure 3:
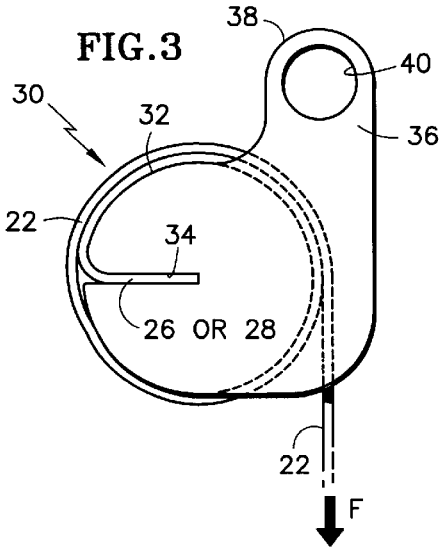
FIG. 3 is a side elevation view of the termination assembly of FIG. 2.
Figure 4:
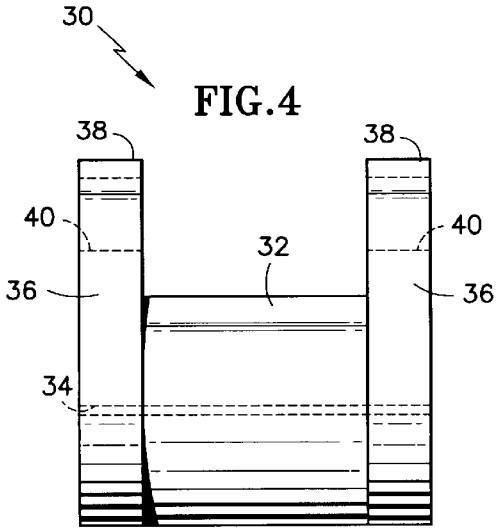
FIG. 4 is a front elevation view of the termination assembly as depicted in FIGS. 2 and 3.

An embodiment of a termination of the present invention will now be described with reference to FIGS. 2, 3 and 4, wherein FIG. 2 is a perspective view of termination device 30, FIG. 3 is a side cross-sectional view of termination device 30 and FIG. 4 is a front elevation view of termination device 30. Termination device 30 includes a central body 32 having a generally cylindrical surface, including an aperture 34 traversing body 32. It is to be understood that body 32 may be a right circular cylinder, an elliptical cylinder or other shaped bodies.

For connection to car 14 or counterweight 16, a support 36 having sockets 38 with apertures 40 is integrally molded or cast with body 32 for passage of a shackle (not shown) or other means of attaching termination device 30 to a dead end hitch (not shown). A view of body 32 behind the support 36 is depicted in phantom. A tension member or rope 22 is wrapped around body 32 having one end inserted within aperture 34 and an opposing end extending away from termination device 30 for holding the load (car or counterweight).

Referring now to FIG. 3, a side elevation view of the termination device is provided. Aperture 34 commences generally at an outer surface of body 32 and ends generally centrally within body 32. Tension member 22 having a car end 26 and a counterweight end 28 is also depicted as having one of the ends 26, 28 inserted into aperture 34, and tension member 22 is wrapped (counterclockwise in the drawing) around the circumference of body 32 past aperture 34 and over itself and continuing to either the car 14 or counterweight 16. Frictional forces exist at the interface of the tension member 22 and the walls of aperture 34 and the outer surface of body 32. These forces react out the load on the tension member. The higher the coefficient of friction available between tension member 22 and body 32, the greater the holding assistance from the friction. The termination device 30 is further enhanced by causing the tension member to provide its own clamping force. More specifically, the desired wrap of tension member 22 over itself creates the clamping force on the first wrap which assists in holding the load. In a specific embodiment, tension member 22 is preferably wrapped about the circumference of body 32 at least 1½ times to provide a greater surface area of frictional contact and to allow the weight of car 14 or counterweight 16 to compress and hold tension member 22 upon itself. Force F is generated by the weight of car 14 or counterweight 16 on the tension member 22. In a preferred embodiment, the termination device is arranged so that the body 32 at the point where force F is tangent to body 32 at the point where the overlap of tension member 22 ends (about 1½ turns).

This arrangement provides maximum compressional forces on the overlapped section of tension member 22. Additionally, there is a high coefficient of friction between the overlapped portions of tension member 22. The termination device as taught is beneficial to the art since it requires less overall height. This is in part because the holding surface area is increased due to multiple wraps.

Still referring to FIGS. 2, 3 and 4, apertures 40 within the socket 38 of support 36 provide a channel through the top portions of support 36, for passage of a shackle, for example. Further, in the embodiment described, a space is provided generally centrally with respect to body 32. Termination device 30 may be cast with such a gap as to minimize materials and associated expenses, decrease mass and allow for a shackle or hitch to be installed therein.

Adjustment may be provided for in the embodiment detailed with reference to FIGS. 2–4 by tightening or loosening a member cooperating with the shackle (not shown), for example, the dead end hitch.

Aperture 34 may be entirely eliminated if desired with the result being slight increase in difficulty in installing the device. It should also be noted that the configuration for aperture 34 may be varied. For example, aperture 34 may be open at each end of body 32 (as shown), thereby allowing tension member 22 to be inserted from either end. Further aperture 34 is depicted in the embodiment described as being parallel to the edges of body 32 and generally at the outermost curved portion of body 32. However, it may be arcuate, sloped, V-shaped, Z-shaped, S-shaped or in the form of some other continuous line. Additionally, aperture 34 may be closed on one end of body 32 and open on the opposite end of body 32. This will allow tension member 22 to be inserted in the lengthwise direction from the end of body 32 having access to aperture 34. Additionally, aperture 34 may be an anchor hole or an anchor slot in which an end 26 or 28 of tension member 22 is inserted. The shape and configuration of aperture 34 may vary, depending on factors such as the ease of access desired and the type of tension member 22 employed (i.e., an aspect ratio of one or an aspect ratio of greater than one).

Figure 5:
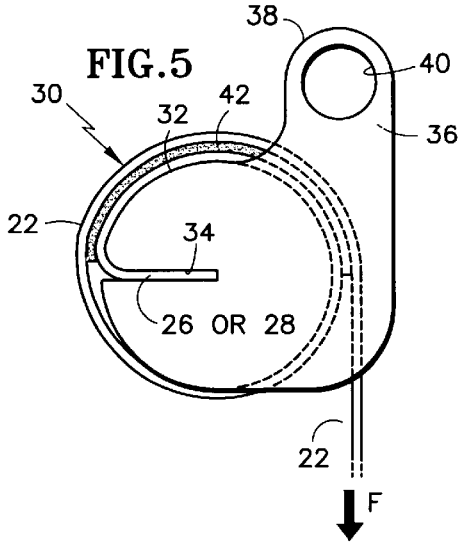
FIG. 5 is a side elevation view of an alternative embodiment of a termination assembly of the present invention.

Referring now to FIG. 5, a side cross-sectional view of another embodiment of a termination device 30 is provided. An end 26 or 28 of tension member 22 is inserted into aperture 34 of body 32, and tension member 22 is wrapped around the circumference of body 32. Instead of wrapping directly upon another portion of tension member 22, however, a plate 40 is included. Plate 40 is arcuate to conform to the circumference of body 32, and is preferably semi- or quarter-circular.

When a force F acts on tension member 22, compressive forces normal to the concavely arcuate surface formed by the winding of tension member 22 are created. These compressive forces act normal to the convex arcuate surface of plate 40 and body 32 around which tension member 22 is wound. Furthermore, the compression of tension member 22 on plate 40 and body 32 creates frictional forces between tension member 22 and body 32 as well as between tension member 22 and plate 40. These frictional forces enhance the holding power of tension member 22.

Plate 40 may be compliant so as to contact and conform to the shape of the layer formed by tension member 22 wound on body 32 immediately below plate 40. Sandwiching plate 40 between two layers of tension member 22 creates additional frictional forces between plate 40 and tension member 22 to further enhance the holding power of tension member 22.

Moreover, utilizing a fireproofed plate 40 to separate the layers of tension member 22 wound on body 32 provides additional fire protection for termination device 30. In such a configuration, a polyurethane layer disposed on tension member 22 may melt or soften sufficiently to enable the steel ropes of tension member 22 to cut through the polyurethane layer, thus allowing the steel ropes of all layers of tension member 22 to group together on the convex arcuate surface of body 32. Plate 40 ensures that in the event of a fire, tension member 22 remains configured in multiple layers and that frictional forces continue to be exerted on tension member 22, thus allowing termination device 30 to maintain its structure integrity.

Additionally, multiple plates 40 may be arranged if tension member 22 is to wrap more than one and one half times around body 32.

Figure 6:
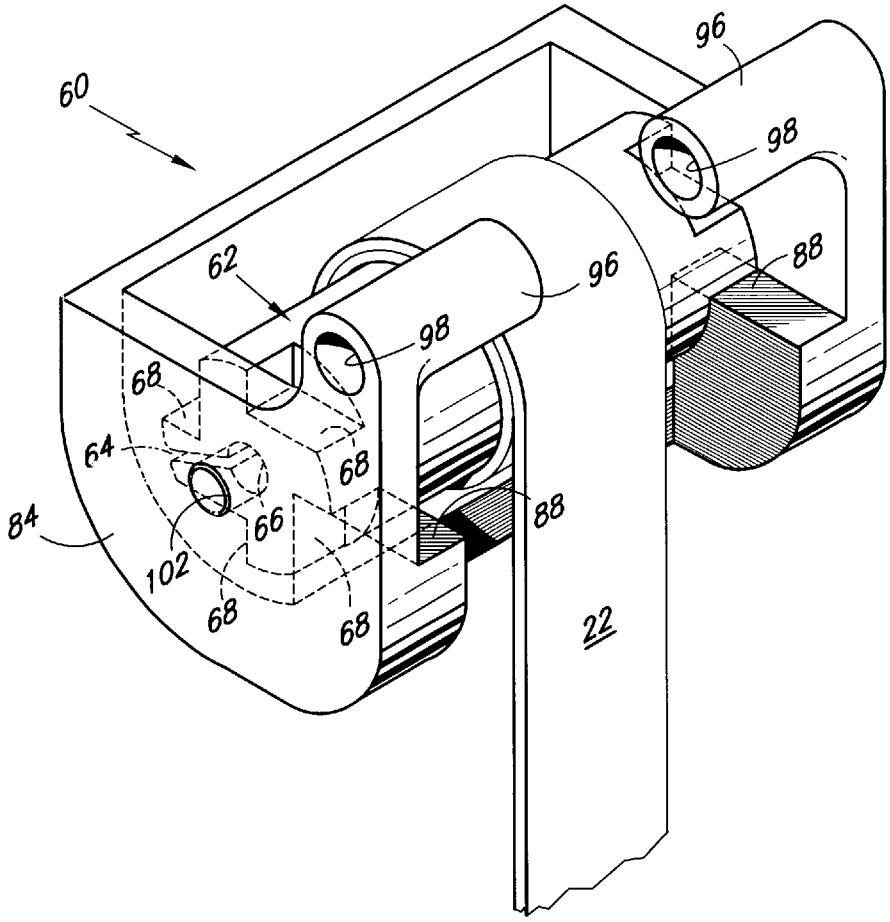
FIG. 6 is a front perspective view of another alternative embodiment of a termination assembly of the present invention.
Figure 7:
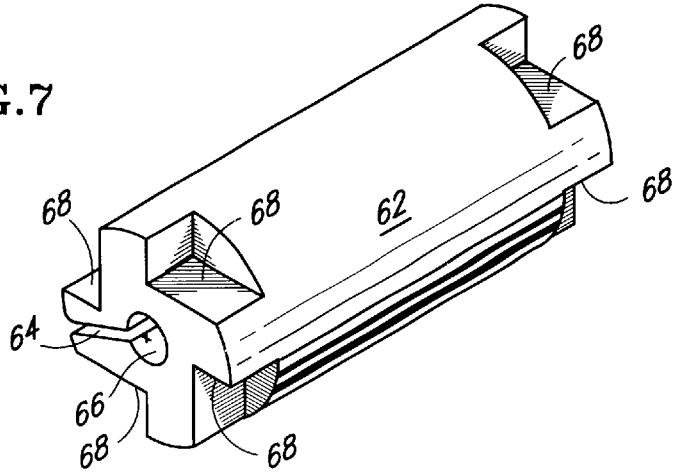
FIG. 7 is a front perspective view of a body within the termination of FIG. 6.

It may be desirable to provide a convenient adjustment mechanism for tension member 22 to increase or decrease its length. An additional configuration providing adjustment for a termination member is depicted in FIGS. 6–12. FIG. 6 is a front perspective view of a termination 60; FIG. 7 is a front perspective view of a body 62 within termination 60; FIG. 8 is a side elevation view of body 62 shown in FIG. 7; FIG. 9 is a front elevation view of body 62 shown in FIGS. 7 and 8; FIG. 10 is a side elevation view of support 84 of termination 60; FIG. 11 is a front elevation view of support 84 shown in FIG. 10; and, FIG. 12 is a side cross-sectional view of termination 60. The various FIGS. 6–12 are used collectively to detail this embodiment of the invention.

Termination 60 includes a body 62 having a generally cylindrical surface seated within a support 84 (partially shown in phantom). Tension member 22 is wrapped around body 62 as described above with reference to the embodiment depicted in FIGS. 2–4, and extends through support 84. Body 62 locks the opposing end of tension member 22 via the frictional forces between tension member 22 and the surface of body 62, the frictional forces between overlapping layers of tension member 22 and the compressional forces of the overlapping layers of tension member 22 from the weight of the load (i.e., car or counterweight). In the embodiment detailed with reference to FIGS. 6–12, body 62 includes an aperture 64 for accepting an end of tension member 22. As with the embodiment described above with reference to FIGS. 2–4, the orientation, direction, and configuration of aperture 64 may vary. Also, aperture 64 may be completely eliminated.

Support 84 further includes holes 98 that are integrally molded or cast within sockets 96 for passage of a shackle (not shown) or other means of attaching termination 60 to a dead end hitch (not shown).

Body 62 is maintained within support 84 by an elongated pin inserted through hole 102 of support 84 and bore 66 of body 62. Rotation of body 62 is prevented as described herein by a series of cutouts 68 at the ends of body 62. Cutouts 68 provide four inside corners that are generally symmetrical about the center of the circular end of body 62. A lock portion 88, complementary in size, shape and position to cutout 68, generally formed as an outside corner, is provided within support 84. One of the pluralities of cutouts 68 of body 62 rests upon lock portion 88. In this manner, when body 62 is seated upon lock portion 88 and an elongated pin is inserted therethrough, body 62 is supported while being prevented from rotation. When it is desired to increase or decrease the length of tension member 22, the elongated pin is removed from body 62 and body 62 is rotated in the appropriate direction to take up or release tension member 22 and a cutout 68 is aligned with and seated upon lock portion 88.

It is understood by those skilled in the art that the relation between cutouts 68 and block portion 88 may vary. For example, instead of providing a series of cutouts 68 in the form of inside corners and corresponding block portion 88 in the form of an outside corner, a reverse configuration is possible. Referring to FIG. 13, for example, a side cross-sectional view of another embodiment is provided. In place of cutouts 68 and block portion 88 of FIGS. 6–12, the embodiment shown in FIG. 13 employs a series of outside corners 128 and lock portion 148 in the form of an inside corner disposed upon support 84 (not shown). Adjustment is effectuated in the same manner as described with reference to FIGS. 6–12.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An elevator tension member termination device comprising:

a body having an outside surface of a predetermined coefficient of friction; and a support structure associated with said body, said support structure being attachable to a separate member, said support structure being positioned such that a tension member wrapped at least 1½ times around said body is positioned to hold a load tangent to said body at a point on said tension member where it has overlapped itself at least ½ times.

2. A termination device as in claim 1, further comprising a socket depending from the body for attaching the body to a load or a support structure.

3. A termination device as in claim 1, wherein the body includes an aperture to accept an end of a tension member.

4. A termination device as in claim 3, wherein the aperture is selected from the group consisting of a hole, a straight slot, an arcuate slot, a V-shaped slot, a S-shaped slot and a Z-shaped slot.

5. A termination device as in claim 1, wherein the body comprises a cylindrical surface.

6. A termination device as in claim 1, wherein the body is oval in cross sectional shape.

7. A termination device as in claim 1 wherein the body and support structure are disassociate and associable in various angular relationships through engageable members thereon.

8. A termination device as in claim 1 wherein the body and support structure each include a lock portion which are engageable with each other in a plurality of positions, said positions being selectable by a user.

9. An elevator system including a car suspended by a rope, the rope having an aspect ratio greater than one, wherein aspect ratio is defined by the ratio of rope width to rope thickness, the elevator system including a rope termination having a body, and wherein the rope is terminated by wrapping the rope around the body such that the rope is retained to the body by frictional forces between the body and the rope and by frictional and compression forces between layers of the rope wrapped around the body.

10. The elevator system according to claim 9, wherein the rope includes a load-carrying member encased within a jacket formed from non-metallic material.

* * * * *